United States Patent [19]

Hai

[11] 4,305,051

[45] Dec. 8, 1981

[54] BROAD BAND POLARIZER WITH A LOW DEGREE OF ELLIPTICITY

[75] Inventor: Nhu B. Hai, Paris, France

[73] Assignee: Thomson-CSF, Paris, France

[21] Appl. No.: 166,682

[22] Filed: Jul. 7, 1980

[30] Foreign Application Priority Data

Jul. 10, 1979 [FR] France ..... 79 17847

[51] Int. Cl.[3] ..... H01P 1/16

[52] U.S. Cl. ..... 333/21 A; 333/242

[58] Field of Search ..... 333/21 A, 208, 241, 333/242, 248, 251

[56] References Cited

U.S. PATENT DOCUMENTS 2,986,713 5/1961 Kent ..... 333/241

*Primary Examiner*—Paul L. Gensler

*Attorney, Agent, or Firm*—Cushman, Darby & Cushman

[57] ABSTRACT

The polarizer with a circular waveguide in the inner wall of which are formed identical circular corrugations positioned in a plane perpendicular to the longitudinal axis XX of the guide. The corrugations have four quadrants: a first pair of quadrants opposed by the apex in which the depth of the corrugations is less than in the second pair. By positioning the waveguide in such a way that the incident field E is parallel to the limit between two adjacent quadrants, the phase velocity of the orthogonal components $C_1$, $C_2$ of field E is dependent respectively on the admittance of the quadrants of the first pair and the quadrants of the second pair. This leads to a phase difference at the polarizer outlet and the corrugations are defined so that this difference is substantially 90°.

3 Claims, 9 Drawing Figures

FIG_1-a
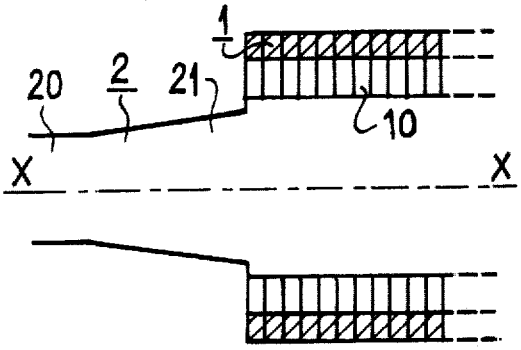
FIG_1-b
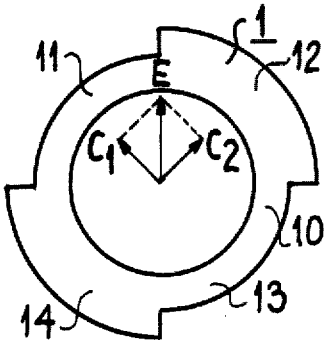
FIG_2
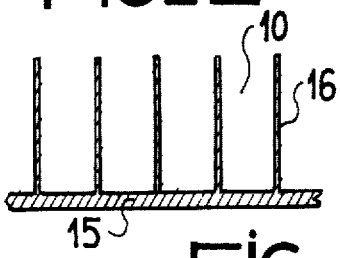
FIG_3
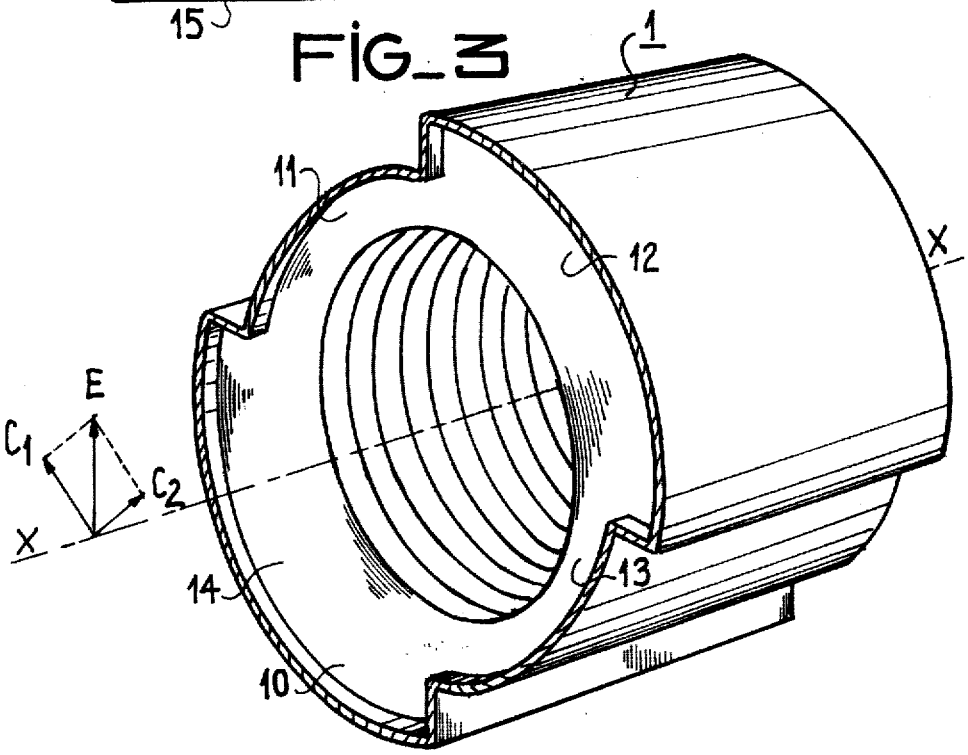

FIG_4
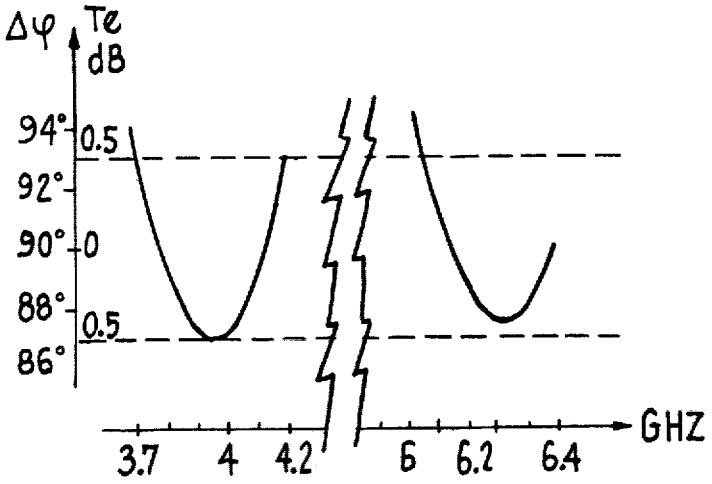
FIG_5-a
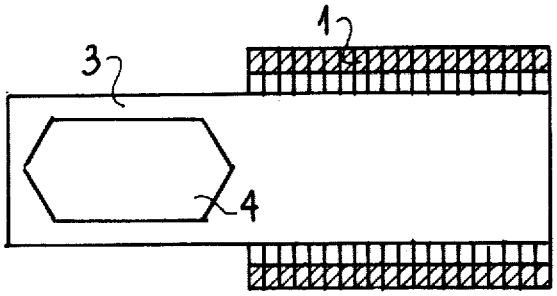
FIG_5-b
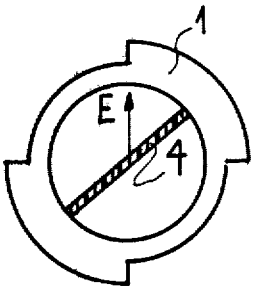
FIG_6-a
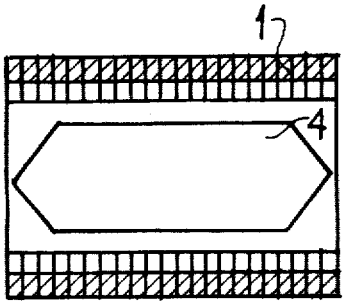
FIG_6-b
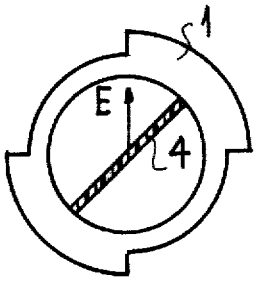

BROAD BAND POLARIZER WITH A LOW DEGREE OF ELLIPTICITY

BACKGROUND OF THE INVENTION

The present invention relates to a broad band polarizer with a low degree of ellipticity realized in a circular waveguide.

Polarizers are known which make it possible to transform linear polarization into circular polarization and vice versa. For this purpose, they produce a phase difference between two components of the field as a result of electromagnetic paths traversed at different phase velocities. If the two components have the same amplitude and the phase difference produced is $\pi/2$ the linear polarization is transformed into circular polarization which is called "right" or "left" depending on whether the rotation direction of the field vector does or does not follow the direction of the hands of a watch, when viewing in the propagation direction.

These known polarizers have a circular waveguide, whose inner wall is smooth. A dielectric plate of length L arranged at 45° with respect to the incident linear field vector is associated with said guide. The phase of the field component parallel to the dielectric plate varies by $2\pi(L/\lambda d)$ ($\lambda d$: wavelength of the wave considered in the dielectric) in the guide portion of length L incorporating the dielectric plate. In this same portion the phase of the field component orthogonal to the dielectric plate varies by $2\pi(L/\lambda g)$ ($\lambda g$: wavelength in the guide). The difference $$\Delta\phi = 2\pi\frac{L}{\lambda g} - 2\pi\frac{L}{\lambda d} = 2\pi L\left(\frac{1}{\lambda g} - \frac{1}{\lambda d}\right)$$

gives the phase delay of the component parallel to the dielectric plate compared with the component orthogonal to the dielectric plate.

These known polarizers having a smooth waveguide and dielectric plate have two main disadvantages. They are not well suited to working at high power levels and substantial losses occur in the dielectric plate.

BRIEF SUMMARY OF THE INVENTION

The object of the invention is to reduce and substantially avoid the aforementioned disadvantages. This is in particular obtained by the use of a waveguide having inner corrugations.

The present invention relates to a broad band polarizer having a low degree of ellipticity incorporating a circular waveguide of longitudinal axis XX having internal corrugations located in planes perpendicular to the axis XX and having a first and a second depth value with the transitions between the depths occurring at the remote edges of two dihedrals each formed by two planes intersecting at a common edge coincident with axis XX.

BRIEF DESCRIPTION OF THE DRAWINGS

The invention is described in greater detail hereinafter relative to non-limitative embodiments and the attached drawings, in which:

FIGS. 1*a* and 1*b* show two views of a first polarizer according to the invention.

FIGS. 2 and 3 show partial detailed views of the polarizer according to FIGS. 1*a* and 1*b*.

FIG. 4 shows a graph relative to the polarizer of FIGS. 1*a* and 1*b*.

FIGS. 5*a* and 5*b* show views of a second polarizer according to the invention.

FIGS. 6*a* and 6*b* show views of a third polarizer according to the invention.

DETAILED DESCRIPTION OF THE PREFERRED EMBODIMENTS

The same components are designated by the same references throughout the drawings.

FIG. 1*a* shows in a diagrammatic longitudinal view a polarizer having a longitudinal axis of symmetry XX. This polarizer comprises a corrugated circular waveguide 1 and a progressive junction 2. The progressive junction 2 comprises a cylindrical waveguide 20 connected to the corrugated waveguide 1 by a frustum-shaped waveguide 21. The corrugated waveguide has 34 identical corrugations. This guide is only partly shown and 11 of the 34 corrugations such as corrugation 10 appear in FIG. 1*a*.

FIG. 1*b* is a diagrammatic cross-sectional view level with corrugation 10 of corrugated waveguide 1.

Each of the 34 identical corrugations of waveguide 1 is hollowed out over 360° within the guide and is perpendicular to axis XX. The depth of the corrugations is not constant. On considering the right-angled dihedrals, and whose common edge is constituted by axis XX, the depth of the corrugation is less in quadrants 11 and 13 in FIG. 1*b* than in quadrants 12 and 14 in FIG. 1*b*. In the present example, the depths of each corrugation are 23.1 and 35.6 mm. The internal diameter of the corrugated guide, not including the corrugations, is 86.4 mm.

FIG. 2 is a part sectional view of the corrugated waveguide according to FIGS. 1*a* and 1*b*. The section is in the form of a plane passing through axis XX (FIG. 1*a*) and intersection the quadrant 13 (FIG. 1*b*). Fig 2 shows the corrugations, such as corrugation 10, the outer wall 15 of the corrugated guide and the wall such as 16 between the corrugations. In the present embodiment, the thickness of the wall between the corrugations is 0.5 mm and the width of the corrugations is 10 mm.

FIG. 3 is a view of a portion of the corrugated guide 1 sectioned along two planes perpendicular to axis XX and whereof one passes within the corrugation 10. FIG. 3 shows the interior of corrugation 10 with its shallow portions 11, 13 and deep portions 12, 14.

The polarizer described hereinbefore relative to FIGS. 1*a*, 1*b*, 2 and 3 operates in the following manner. The polarizer is positioned in such a way that the incident field E (FIGS. 1*b* and 3) is parallel to one of the two planes marking the transition between the two different depths of the corrugations. $C_1$ and $C_2$ are two orthogonal components of field E (FIGS. 1*b* and 3). The phase velocity of component $C_1$ is corrugated guide 1 is dependent on the admittance of quadrants 11 and 13, whilst the phase velocity of component $C_2$ is dependent on the admittance of quadrants 12 and 14. However, the difference in the depths leads to a difference in admittances and therefore a difference between the phase velocities of the components $C_1$ and $C_2$ of the field during the passage through the corrugated guide of the polarizer.

In the embodiment described relative to FIGS. 1*a* to 3, the depths have been chosen in such a way that the influence of the corrugations on the phase velocity of components $C_1$ and $C_2$ is inverted in the 4 GHz bands (3.7 to 4.2 GHz) and the 6 GHz bands (5.925 to 6.425 GHz). Thus, in the 4 GHZ band, the standardized susceptance of the corrugations is very small (between 0.730 and 2.20) for quadrants 11, 13 and very large (between 9.50 and 96.3) for quadrants 12, 14. However, in the 6 GHz band, the standardized susceptance is very large (between 7.5 and 126) for quadrants 11, 13 and very small (between −2.41 and 0.167) for quadrants 12, 14.

It should also be noted that the phase displacement between components $C_1$ and $C_2$ brought about by the polarizer according to FIGS. 1*a* to 3 is identical in both the 4 GHz and 6 GHz bands.

FIG. 4 is a graph showing the values of the degree of ellipticity $T_e$ (or, and this means the same, the phase displacement $\Delta\phi$ between components $C_1$ and $C_2$ of the field) obtained as a function of the working frequency in the abscissa using the polarizer described hereinbefore. As can be gathered from the graph, this polarizer makes it possible to pass from linear polarization to circular polarization with a degree of ellipticity which does not exceed 0.67 dB in the 4 GHz band and 0.7 dB in the 6 GHz band.

FIGS. 5*a* and 5*b* are diagrammatic views, respectively in longitudinal and cross-section of another polarizer according to the invention. This polarizer differs from that of FIGS. 1*a* and 1*b* by the fact that a waveguide 3 in which is provided a dielectric plate 4 is arranged in series with the corrugated guide 1 to which it is fixed. Waveguide 3 is a circular guide with a smooth inner wall.

With respect to the incident field E (FIG. 5*b*) the dielectric plate 4 is arranged at 45° and the corrugated guide 1 is positioned as shown in FIG. 1*b*. The polarizer according to FIGS. 5*a* and 5*b* can be considered as the combination of a portion of a conventional polarizer (circular waveguide 3 containing a dielectric plate positioned at 45° relative to the field) and a portion of a polarizer constituted by a circular waveguide having corrugations of variable depths. The phase displacements introduced by the dielectric plate and the corrugations are summated and are provided to give a total phase displacement which is as close as possible to 90° in the frequency band or bands in which the polarizer is used.

A polarizer for the 4 and 6 GHz bands has been realized in accordance with FIGS. 5*a* and 5*b*. In the case of this polarizer, the dielectric plate causes a first average phase displacement in the 4 GHz band and a second average phase displacement in the 6 GHz band, said phase displacements differing by 90°. By a suitable choice of the number, depths and widths of the corrugations, corrugated guide 1 brings about the total mean phase displacement of the polarizer as close as possible to 90° in each of the two frequency bands.

FIGS. 6*a* and 6*b* are diagrammatic views, respectively in longitudinal and cross-section of another exemplified polarizer according to the invention. This polarizer mainly differs from the polarizer of FIGS. 5*a* and 5*b* through the absence of the smooth guide 3 and through the introduction of a dielectric plate 4 into a corrugated guide. Here again, the total phase displacement introduced by the polarizer is produced on the one hand by the dielectric plate 4 and on the other by the corrugations of waveguide 1. With the exception that the smooth waveguide is absent, all that has been stated hereinbefore relative to the polarizer of FIGS. 5*a* and 5*b* applies to the polarizer of FIGS. 6*a* and 6*b*.

It should be noted that the polarizers described hereinbefore, as well as those which can be conceived without passing beyond the scope of the invention, can be used more particularly in the field of radar, in antennas of earth-bound stations and antennas installed in satellites. More specifically, the polarizers according to the invention can be used in equipment whenever it is necessary to have a polarizer leading to a low degree of ellipticity and having a high power response.

What is claimed is:

1. A broad band polarizer having a low degree of ellipticity incorporating a circular waveguide having a longitudinal axis XX and internal corrugations located in planes perpendicular to the axis XX, each of said corrugations having a first and a second depth value with the transitions therebetween occurring at the remote edges of a first and a second right-angled dihedral, each formed by two planes intersecting at a common edge coincident with axis XX.

2. A polarizer according to claim 1 also comprising a dielectric plate arranged within said waveguide in a plane bisecting the dihedrals of the two pairs of dihedrals.

3. A polarizer according to claim 1 also comprising: another circular waveguide having a longitudinal axis formed by said axis XX, said other waveguide being joined to the first mentioned waveguide; and a dielectric plate arranged within said other waveguide in a plane bisecting the dihedrals of the two pairs of dihedrals.

* * * * *